US005613884A

United States Patent [19]

Krivec

[11] Patent Number: 5,613,884

[45] Date of Patent: Mar. 25, 1997

[54] POSITION LATCH DEVICE

[75] Inventor: Bert Krivec, Waukesha, Wis.

[73] Assignee: Snap-on Technologies, Inc., Crystal Lake, Ill.

[21] Appl. No.: 467,060

[22] Filed: Jun. 6, 1995

[51] Int. Cl.[6] ..... H01R 11/24

[52] U.S. Cl. ..... 439/822; 439/829; 24/518; 24/521

[58] Field of Search ..... 439/822, 829; 24/518, 521

[56] References Cited

U.S. PATENT DOCUMENTS

| | | | |
|---|---|---|---|
| 1,725,638 | 3/1932 | Hellermann . | |
| 2,532,141 | 11/1950 | Barkan et al. . | |
| 3,540,106 | 11/1970 | Goldman . | |
| 3,619,890 | 11/1971 | Kubokawa . | |
| 3,681,840 | 8/1972 | Pool . | |
| 4,153,321 | 5/1979 | Pombrol . | |
| 4,932,905 | 6/1990 | Richards | 439/822 |
| 4,934,957 | 6/1990 | Bellsuci . | |
| 4,975,089 | 12/1990 | Lee . | |
| 5,021,008 | 6/1991 | Scherer . | |
| 5,167,529 | 12/1992 | Verge . | |
| 5,254,020 | 10/1993 | Obligar . | |

*Primary Examiner*—Neil Abrams

*Assistant Examiner*—Eugene G. Byrd

*Attorney, Agent, or Firm*—Emrich & Ditmar

[57] ABSTRACT

A position latch device is used with a clamp of the type including a pair of pivotally coupled gripping members respectively defining gripping jaws at one end and first and second handle portions at the opposite end. The gripping members are operable between a latched open-jaw condition and a non-latched closed-jaw condition. The position latch device includes a resilient spring extending from the first handle portion toward the second handle portion in an arcuate manner and deflectable by the second handle portion as the gripping members move from the closed-jaw condition to the open jaw condition so as to exert on the second handle portion a force component in a direction opposite the direction of movement of the second handle portion. The spring has a fixed end connected to the first handle portion and a free end. The latch device further includes a latching abutment disposed adjacent to the free end of the spring and engageable in the latched condition with the second handle portion in response to movement of the clamp from the closed-jaw condition to retain the clamp against movement toward the closed-jaw condition. The abutment is disengageable from the latched condition in response to application to the free end of a release force having a substantial component in the direction of movement of the second handle member toward the open-jaw condition.

20 Claims, 1 Drawing Sheet

POSITION LATCH DEVICE

BACKGROUND OF THE INVENTION

1. Field of the Invention

The present invention relates generally to position latch devices and, more particularly, to a position latch device for use with clamping devices and the like.

2. Description of the Prior Art

Battery jumper cable clamps are used to attach the jumper cables to the terminals of a battery. The clamps presently used suffer from a number of disadvantages. Battery clamps are generally comprised of two elongated gripping handles pivotally joined at a central portion to provide a pair of gripping jaws at a front end thereof. Most commonly, the gripping jaws are biased by the pivot mechanism to a normally closed position. Consequently, in order for the clamp to be placed onto a battery post or terminal, the clamp handles must be loaded, by pressing them together, by a force sufficient to overcome the biasing force of the pivot mechanism. Because the pivot biasing force is usually quite large to insure a solid grip by the gripping jaws on the battery terminal, the continuous loading force that must be applied to overcome such biasing force is often too great for some users, specifically those with weak hands, including children and those with an arthritic condition. This is particularly true when the battery terminal is set deep in the engine compartment where two hand loading is often not possible and it is difficult or awkward for a user to maintain a loading force on the compressed handles long enough to position the open jaws over the battery post.

Thus, there is a need for a battery clamp having a position latch device which would allow the clamp to be held open without a continuous loading (squeezing) force on the clamp handles.

SUMMARY OF THE INVENTION

It is a general object of the present invention to provide a position latch device for a clamp which is economical and easy to integrate with the clamp.

It is another object of the present invention to provide a latch device for use with a battery clamp which allows a user to latch the gripping jaws of the battery clamp into an open-jaw condition, but releasable into the closed jaw condition by the application of a small release force once the clamp jaws are in position over the battery terminal.

It is yet another object of the present invention to provide a position latch device for use with any of a number of different clamps having pivoting handles normally biased to a closed-jaw condition.

These and other features of the present invention are attained by providing a position latch device for use with a clamp of the type including a pair of pivotally coupled gripping members respectively defining gripping jaws at one end and first and second handle portions at the opposite end. The gripping members are operable between a latched open-jaw condition and a non-latched closed-jaw condition. The position latch device includes a resilient spring extending from the first handle portion toward the second handle portion in an arcuate manner and deflectable by the second handle portion as the gripping members move from the closed-jaw condition to the open jaw condition so as to exert on the second handle portion a force component in a direction opposite the direction of movement of the second handle portion. The spring has a fixed end connected to the first handle portion and a free end. The latch device further includes a single latching abutment disposed adjacent to the free end of the spring and engageable in the latched condition with the second handle portion in response to movement of the clamp from the closed-jaw condition to retain the clamp against movement toward the closed-jaw condition, the abutment is disengageable from the latched condition in response to application to the free end of the spring of a release force having a substantial component in the direction of movement of the second handle member toward the open-jaw condition. The latch device may be provided with two abutments for added position variability.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

DETAILED DESCRIPTION OF THE PREFERRED EMBODIMENTS

Figure 1:
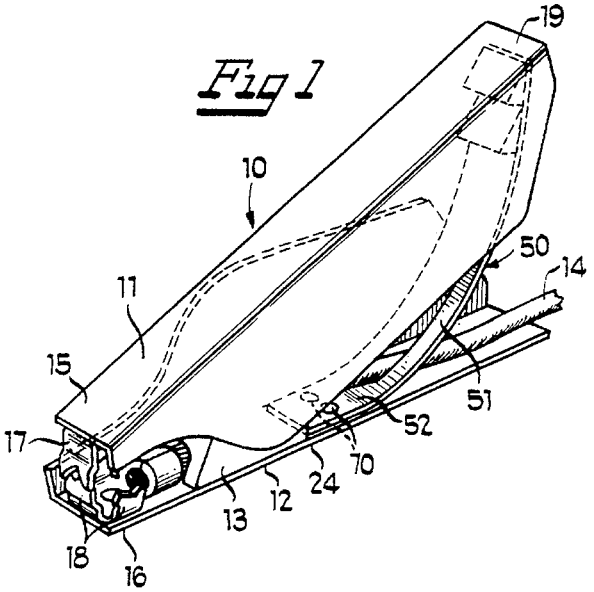
FIG. 1 is a perspective view of a battery jumper cable clamp including a position latch device constructed in accordance with and embodying the features of the present invention with the clamp disposed in its non-latched, at-rest, closed-jaw condition.
Figure 2:
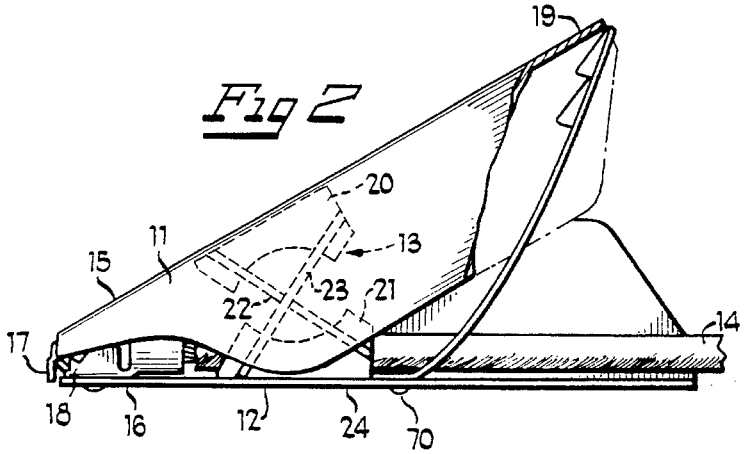
FIG. 2 is a side elevational view of the clamp of FIG. 1, with a portion broken away to show the position latch device.

Referring to FIGS. 1–2, there is illustrated a battery jumper cable clamp 10 having attached thereto a position latch device 50, the latter constructed in accordance with and embodying the features of the present invention.

The jumper cable clamp 10 includes a first or upper gripping member 11 and a second or lower gripping member 12 pivotally interconnected by a pivot assembly 13 and biased thereby into the closed state which is shown. Lower gripping member 12 is suitably connected to an electrical connector, such as a cable 14.

The forward end portions 15, 16 of gripping members 11, 12 are normally biased together and are separable when a manual force is applied to the rear or handle ends of the gripping member 11, 12. The forward ends 15, 16 have associated teeth 17, 18 on the inner faces thereof to form jaws for gripping a battery terminal. In the illustrated embodiment, each of the gripping members 11, 12 is generally L-shaped in transverse cross section, however, it should be appreciated that they may be sized and shaped in any number of ways. An end 19 on upper gripping member 11 engages the position latch device 50 in the manner described below.

Figure 5:
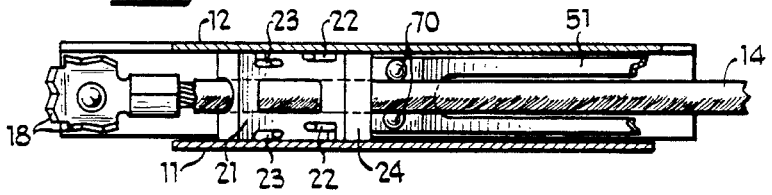
FIG. 5 is a horizontal sectional view taken generally along the line 5—5 in FIG. 4.

The pivot assembly 13 is shown in phantom in FIG. 2 and includes first and second aluminum brackets 20, 21 welded to the undersides of members 11, 12, respectively, and each having a plurality of slots formed therein into which are received the respective ends of resiliently deflectable spring wire sections 22, 23, there being a total of two pairs of crossed wire sections for a total of four wire sections (see FIG. 5). The pivot assembly 13 forms no part of the present invention and is the subject of a related co-pending application, now Ser. No. 483,713, entitled Wire Flex Pivot, by the inventor of the present invention. It should be appreciated that the pivot assembly 13 is shown for illustrative purposes only and that any conventional pivot assembly functioning to bias the gripping members 11, 12 to a normally closed-jaw condition may be substituted.

Figure 3:
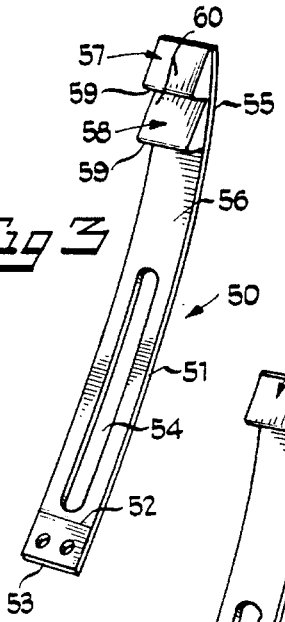
FIG. 3 is a slightly enlarged, perspective view of the position latch device shown in FIGS. 1 and 2.

FIG. 3 shows the position latch device 50 of the present invention prior to its connection to a battery clamp 10. The position latch device 50 is connected to the clamp 10 at a portion 24 midway along the length of one leg of lower gripping member 12, as shown in FIGS. 1–2.

The latch device 50 comprises a thin, flat, elongated body 51 made of a strip of spring steel material and having a curved geometry such that in its at-rest position the elongated body 51 extends upwardly, in an arcuate manner, from lower gripping member 12 toward the end 19 of upper gripping member 11.

The end 52 of latch device 50 is provided with holes 53 to facilitate fastening the latch device 50 to the clamp 10 using fasteners 70, such as screws or the like. An opening 54 is formed in the middle of body 51 and dimensioned to provide the desired spring force and resilience of the latch device 50. On the opposite end 55 along the inner arcuate surface 56 of latch device 50 are disposed two latching abutments 57, 58 shown disposed adjacent to each other and each having a triangular cross-sectional shape defined by a wall 59, substantially perpendicular to the surface 56, and a wall 60 inclined at an acute angle to the surface 56. The latching abutments 57, 58 are preferably made of plastic, though other suitable materials may be used instead, and are attached adjacent to end 55 of body 51 by suitable mechanical or adhesive means (not shown).

Referring back to FIG. 2, the position latch device 50 is shown attached to the clamp 50 with the latter disposed in the normal or at-rest, closed-jaw condition. In this condition, the latch device 50 is shown only slightly resiliently deflected with the inclined wall 60 of the upper abutment 57 touching the end 19 of upper gripping member 11 and exerting a upward force thereon. This force includes a force component opposite the direction of movement of the gripping member 11 with respect to its pivotal movement toward lower gripping member 12.

Figure 4:
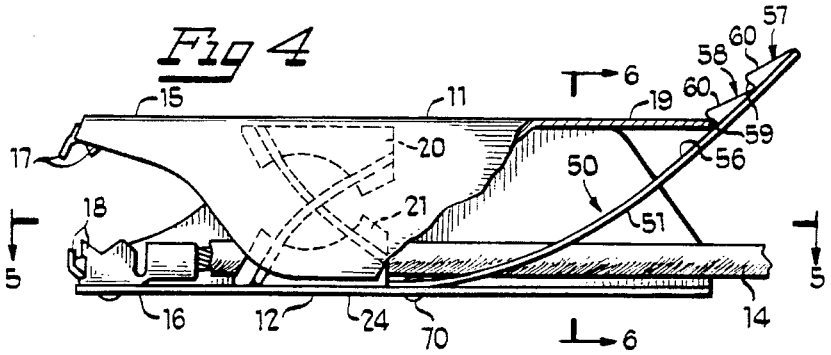
FIG. 4 is a view similar to FIG. 2, but showing the clamp latched in the open-jaw condition.

When a manual gripping force is applied to the clamp 10, gripping member 11 will pivot about the pivot axis of the pivot assembly 13 and to the open-jaw condition. As the gripping member 11 is pivoted, its end 19 exerts a loading force on the latch device 50, deflecting it downwardly toward lower gripping member 12, the end 19 camming past the latching abutments 57 and 58, in a ratcheting-like manner, and become lockingly engaged between the surface 56 of latch device 50 and the vertical wall 59 of abutment 58, as shown by the latched, open-jaw condition in FIGS. 4–6. In a similar manner, end 19 may alternatively be engaged against the vertical wall 59 of abutment 57 to latch the clamp jaws a smaller distance apart.

Figure 6:
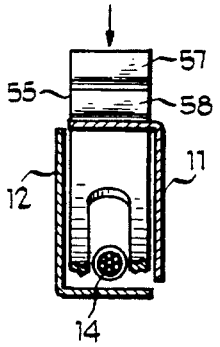
FIG. 6 is a vertical sectional view taken generally along the line 6—6 in FIG. 4.

It should be appreciated that the latch 50 must also be sufficiently deflectable that a small vertical release force applied to the end 55 of latch device 50, having a force component in the direction shown by the arrow in FIG. 6, will disengageably deflect the latch device 50 away from end 19 of upper gripping member 11 thereby permitting the clamp 10 to be biased by the pivot assembly 13 back to the non-latched, at-rest, closed-jaw condition, shown in FIGS. 1–2.

Figure 7:
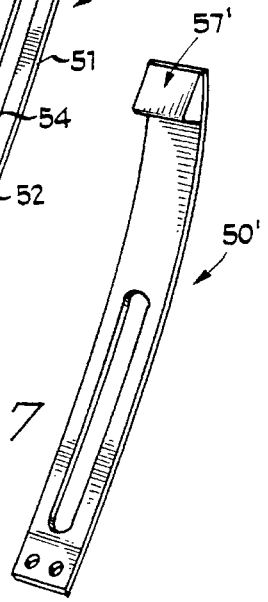
FIG. 7 is a view similar to the view in FIG. 3 showing a position latch device in accordance with another embodiment of the invention.

In an alternative embodiment shown in FIG. 7, the latch device 50' is shown provided with a single latching abutment 57'. A single abutment is not only more cost effective than a multi-abutment latch device 50, but in certain applications such as with battery clamps, where a single open-jaw position may accommodate attaching the clamp 10 onto most, if not all, variable size battery terminals, a single abutment latch device may be most practical.

It should be appreciated that, while the position latch device 50, 50' has been disclosed for connection to a battery jumper cable clamp, it can easily be incorporated for use with like clamping devices of the type having gripping members 11, 12 operable between a latched open-jaw condition and a non-latched, closed-jaw condition.

While particular embodiments and several specific forms of tools of the present invention have been shown and described, it will be appreciated by those skilled in the art that additional changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

We claim:

1. A position latch device for use with a clamp of the type including a pair of pivotally coupled gripping members respectively defining gripping jaws at one end and first and second handle portions at the opposite end, the gripping members being operable between a latched open-jaw condition and a non-latched closed-jaw condition, said position latch device comprising:

a bias mechanism resiliently urging the gripping members to the closed-jaw condition, a resiliently deflectable spring extending from the first handle portion toward the second handle portion in an arcuate manner and resiliently deflectable thereby as the gripping members move from the closed-jaw condition to the open-jaw condition so as to exert on the second handle portion a force component opposite the direction of movement of the second handle portion, said spring having a fixed end connected to the first handle portion and a free end; and at least one latching abutment disposed adjacent to the free end of said spring and engageable in the latched condition with the second handle portion in response to movement of the clamp from the closed-jaw condition to retain the clamp against movement toward the closed-jaw condition, said at least one abutment being disengageable from the latched condition in response to application to the free end of a release force having a substantial component in the direction of movement of the second handle member toward the open-jaw condition.

2. The position latch device of claim 1, wherein said spring is made from spring steel material.

3. The position latch device of claim 2, wherein said spring is a thin, flat, elongated member with predetermined at-rest curvature.

4. The position latch device of claim 3, wherein said at least one abutment is triangular in cross-sectional shape.

5. The position latch device of claim 4, wherein said at least one abutment is made from a plastic material.

6. The position latch device of claim 5, wherein said spring includes only one abutment.

7. The position latch device of claim 5, wherein said spring includes two abutments.

8. The position latch device of claim 1, wherein the clamping device is a battery jumper cable clamp.

9. The position latch device of claim 1, wherein the free end of said spring has a substantially flat surface, and said at least one abutment has first and second intersecting surfaces, the first surface being inclined at an acute angle to the flat surface and the second surface being substantially perpendicular to the flat surface.

10. The position latch device of claim 1, wherein said spring is connected to the first handle portion by at least one screw.

11. The position latch device of claim 1, wherein said spring has an opening formed therein.

12. A position latch device for use with a clamp of the type including a pair of pivotally coupled gripping members respectively defining gripping jaws at one end and first and second handle portions at the opposite end, the gripping members being operable between a latched open-jaw condition and a non-latched closed-jaw condition, said position latch device comprising:

a bias mechanism resiliently urging the gripping members to the closed-jaw condition, a resiliently deflectable spring extending from the first handle portion toward the second handle portion in an arcuate manner and resiliently deflectable thereby as the gripping members move from the closed-jaw condition to the open-jaw condition so as to exert on the second handle portion a force component opposite the direction of movement of the second handle portion, said spring having a fixed end connected to the first handle portion and a free end;

a single latching abutment disposed adjacent to the free end of said spring and engageable in the latched condition with the second handle portion in response to movement of the clamp from the closed-jaw condition to retain the clamp against movement toward the closed-jaw condition.

13. The position latch device of claim 12, wherein said spring is made from spring steel material.

14. The position latch device of claim 13, wherein said spring is a thin, flat, elongated member with predetermined at-rest curvature.

15. The position latch device of claim 14, wherein said at least one abutment is triangular in cross-sectional shape.

16. The position latch device of claim 15, wherein said at least one abutment is made from a plastic material.

17. The position latch device of claim 12, wherein the clamping device is a battery jumper cable clamp.

18. The position latch device of claim 12, wherein the free end of said spring has a substantially flat surface, and said abutment has first and second intersecting surfaces, the first surface being inclined at an acute angle to the flat surface and the second surface being substantially perpendicular to the flat surface.

19. The position latch device of claim 12, wherein said spring is connected to the first handle portion by at least one screw.

20. The position latch device of claim 12, wherein said spring has an opening formed therein.

* * * * *